US005546766A

United States Patent [19]

Higginbotham

[11] Patent Number: 5,546,766

[45] Date of Patent: Aug. 20, 1996

[54] AIR SEPARATION

[75] Inventor: Paul Higginbotham, Guildford, United Kingdom

[73] Assignee: The BOC Group plc, Windlesham, United Kingdom

[21] Appl. No.: 446,998

[22] Filed: May 22, 1995

[30] Foreign Application Priority Data

May 27, 1994 [GB] United Kingdom ..... 9410696

[51] Int. Cl.[6] ..... F25J 3/02

[52] U.S. Cl. ..... 62/645; 62/654; 62/924

[58] Field of Search ..... 62/22, 24, 38, 62/41

[56] References Cited

U.S. PATENT DOCUMENTS 4,715,873 12/1987 Auvil et al. ..... 62/13
5,195,324 3/1993 Cheung ..... 62/24
5,305,611 4/1994 Howard ..... 62/41
5,440,884 8/1995 Bonaquist et al. ..... 62/22

*Primary Examiner*—Ronald C. Capossela
*Attorney, Agent, or Firm*—David M. Rosenblum; Larry R. Cassett

[57] ABSTRACT

Air is compressed in a compressor, purified in a purification unit, cooled by passage through a main heat exchanger and separated in a double rectification column comprising a higher pressure rectification column and a lower pressure rectification column. A stream of argon-enriched oxygen vapour is withdrawn from the lower pressure rectification column through an outlet and an argon product is separated from it in an argon rectification column provided with an argon condenser. Argon is condensed in the condenser by indirect heat exchange with a second stream of air at a pressure between the operating pressures of the columns. The second air stream is partially condensed and passed into a phase separator. A stream of liquid phase is withdrawn from the phase separator, is passed through a throttling valve and the condenser, in sequence. Further cooling for the condenser is thus provided.

19 Claims, 2 Drawing Sheets

AIR SEPARATION

BACKGROUND OF THE INVENTION

This invention relates to a method and apparatus for separating air.

The most important method commercially for separating air is by rectification. In typical air rectification processes there are performed the steps of compressing a stream of air, purifying the resulting stream of compressed air by removing water vapour and carbon dioxide from it, and precooling the stream of compressed air by heat exchange with returning product streams to a temperature suitable for its rectification. The rectification is performed in a so-called "double rectification column" comprising a higher pressure column and a lower pressure column, i.e. one of the two columns operates at a higher pressure than the other. Most of the incoming air is introduced into the higher pressure column and is separated into oxygen-enriched liquid air and a nitrogen vapour. The nitrogen vapour is condensed. Part of the condensate is used as liquid reflux in the higher pressure column. Oxygen-enriched liquid is withdrawn from the bottom of the higher pressure column and is used to form a feed stream to the lower pressure column. Typically, the oxygen-enriched liquid stream is sub-cooled and introduced into an intermediate region of the lower pressure column through a throttling or pressure reduction valve. The oxygen-enriched liquid air is separated into substantially pure oxygen and nitrogen in the lower pressure column. Gaseous oxygen and nitrogen products are taken from the lower pressure column and typically form the returning streams against which the incoming air is heat exchanged. Liquid reflux for the lower pressure column is provided by taking the remainder of the condensate from the higher pressure column, sub-cooling it, and passing it into the top of the lower pressure column through a throttling valve. An upward flow of vapour through the lower pressure column from its bottom is created by reboiling liquid oxygen. The reboiling is carried out by heat exchanging the liquid oxygen at the bottom of the lower pressure column with nitrogen from the higher pressure column. As a result, the condensed nitrogen vapour is formed.

A local maximum concentration of argon is created at an intermediate level of the lower pressure column beneath that at which the oxygen-enriched liquid air is introduced. If it is desired to produce an argon product, a stream of argon-enriched oxygen vapour is taken from a vicinity of the lower pressure column where the argon concentration is typically in the range of 5 to 15% by volume of argon, and is introduced into a bottom region of a side column in which an argon product is separated therefrom. Reflux for the argon column is provided by a condenser at the head of the column. The condenser is cooled by at least part of the oxygen-enriched liquid air upstream of the introduction of such liquid air into the lower pressure column.

An example of the above described process is described in EP-B-0 377 117. A problem that arises in the operation of the process under certain conditions which tend to reduce the liquid/vapour ratio in the lower pressure rectification column is that the yield of argon tends to be less than it would otherwise be without the reduction in the liquid/vapour ratio. Examples of the conditions that can cause this phenomenon to occur are the introduction of a substantial proportion of feed air directly into the lower pressure rectification column, the taking of a nitrogen product directly from the higher pressure column, and the introduction into the double rectification column of a substantial proportion of the feed air in liquid state. Another cause of an undesirably low argon yield is an insufficient number of trays or height of packing in the lower pressure rectification column. It is an aim of the present invention to provide a method and plant that are more able to maintain the argon yield in such circumstances, or at least some of them, than the process described in EP-B-0 377 117.

SUMMARY OF THE INVENTION

According to the present invention there is provided a method of separating air comprising compressing and purifying the air, rectifying a first stream of the compressed purified air in a double rectification column comprising a higher pressure column and a lower pressure column, withdrawing oxygen-rich and nitrogen-rich product streams from the double rectification column, rectifying in an argon rectification column a stream of argon-enriched fluid withdrawn from the lower pressure column so as to obtain argon-rich vapour at the head of the argon rectification column, condensing at least some of the said argon-rich vapour and employing at least some of the resulting condensate in the argon rectification column as reflux, and withdrawing an argon-rich product stream from the argon rectification column, characterised by partially reboiling a second stream of compressed, purified air in a liquid state at a pressure greater than that at the top of the lower pressure column but less than that at the top of the higher pressure column so as to form an oxygen-enriched liquid and an oxygen-depleted vapour, disengaging the oxygen-enriched liquid from the oxygen-depleted vapour, condensing a stream of the oxygen-depleted vapour, and introducing the condensed oxygen-depleted vapour stream into the lower pressure rectification column, wherein the partial reboiling of the second stream of air is performed by indirect heat exchange thereof with said condensing argon-rich vapour.

The invention also provides an air separation plant comprising a double rectification column comprising a higher pressure column and a lower pressure column for rectifying a first stream of compressed, purified air, said double rectification column having an oxygen outlet for an oxygen-rich product stream and a nitrogen outlet for a nitrogen rich product stream; an argon rectification column having an inlet for a stream of argon-enriched fluid communicating with an argon outlet from the lower pressure column for said stream of argon-enriched fluid; an argon product outlet from the argon rectification column for an argon-rich product; and a first condenser for condensing argon-rich vapour separated in the argon rectification column and for sending at least some of the condensate to the argon rectification column as reflux, characterised in that the first condenser includes a set of heat exchange passages for partially reboiling a second stream of compressed, purified air in liquid state at a pressure greater than that at the top of the lower pressure column but less than that at the top of the higher pressure column so as to form in use an oxygen-enriched liquid and an oxygen-depleted vapour; the plant additionally includes a phase separator for disengaging the oxygen-enriched liquid from the oxygen-depleted vapour, and a second condenser having heat exchange passages for condensing a stream of the oxygen-depleted vapour, said reboiling passages of the first condenser communicating with the lower pressure column.

Preferably, the said disengaged oxygen-enriched liquid is used to perform a condensing duty. In one preferred example of the method according to the invention, a stream of the disengaged oxygen-enriched liquid is reduced in pressure by passage through a suitable device such as a throttling valve and the resulting pressure-reduced stream of oxygen-enriched liquid supplements the second stream of air in condensing said argon-rich vapour. Accordingly, the first condenser in such example has another set of reboiling passages for the pressure-reduced stream of oxygen-enriched liquid. The pressure-reduced stream of oxygen-enriched liquid is itself reboiled by indirect heat exchange with the condensing argon-rich vapour and the resulting reboiled stream is preferably introduced into the lower pressure rectification column. The disengaged oxygen-enriched liquid may alternatively be used to perform a different condensing duty for example in a condenser located intermediate two intermediate mass exchange levels of the argon column. In such an alternative example of the method according to the invention the disengaged oxygen-enriched liquid stream may enter the said intermediate condenser at substantially the same pressure as that at which the said disengagement is performed, and resulting reboiled oxygen-enriched liquid is preferably returned to the lower pressure rectification column. Another alternative which may sometimes be available if a particularly high rate of liquid air formation is able to be achieved is to use a second stream of the disengaged oxygen-enriched liquid to condense the oxygen-depleted vapour, the second stream being itself reboiled and preferably introduced into the lower pressure rectification column.

The stream of oxygen-depleted vapour is preferably condensed by indirect heat exchange with a stream of oxygen-enriched liquid withdrawn from the higher pressure column. Downstream of this heat exchange, resulting reboiled oxygen-enriched liquid is preferably introduced into the lower pressure rectification column.

The second compressed, purified air stream may for example be formed in liquid state by heat exchanging a stream of compressed, purified air with a stream of oxygen-rich product in liquid state, and passing the heat exchanged stream of compressed, purified air through a throttling valve.

If desired, the second compressed, purified air stream may alternatively be taken in liquid state from approximately the same intermediate mass exchange level of the higher pressure column as that to which a precursor compressed purified air stream is fed in liquid state. Such an arrangement is an example of one that enables the second compressed and purified air stream to be formed at a different rate from that at which air is liquefied, for example, by heat exchange with liquid oxygen product. If the source of the second air stream is the said intermediate level of the higher pressure column, the composition of the second air stream is approximately the same as that of the precursor air stream but may contain, say, 22 or 23% by volume of oxygen.

BRIEF DESCRIPTION OF THE DRAWINGS

Methods and plant according to the present invention will now be described by way of example with reference to the accompanying drawings in which.

The drawings are not to scale.

DETAILED DESCRIPTION

Figure 1:
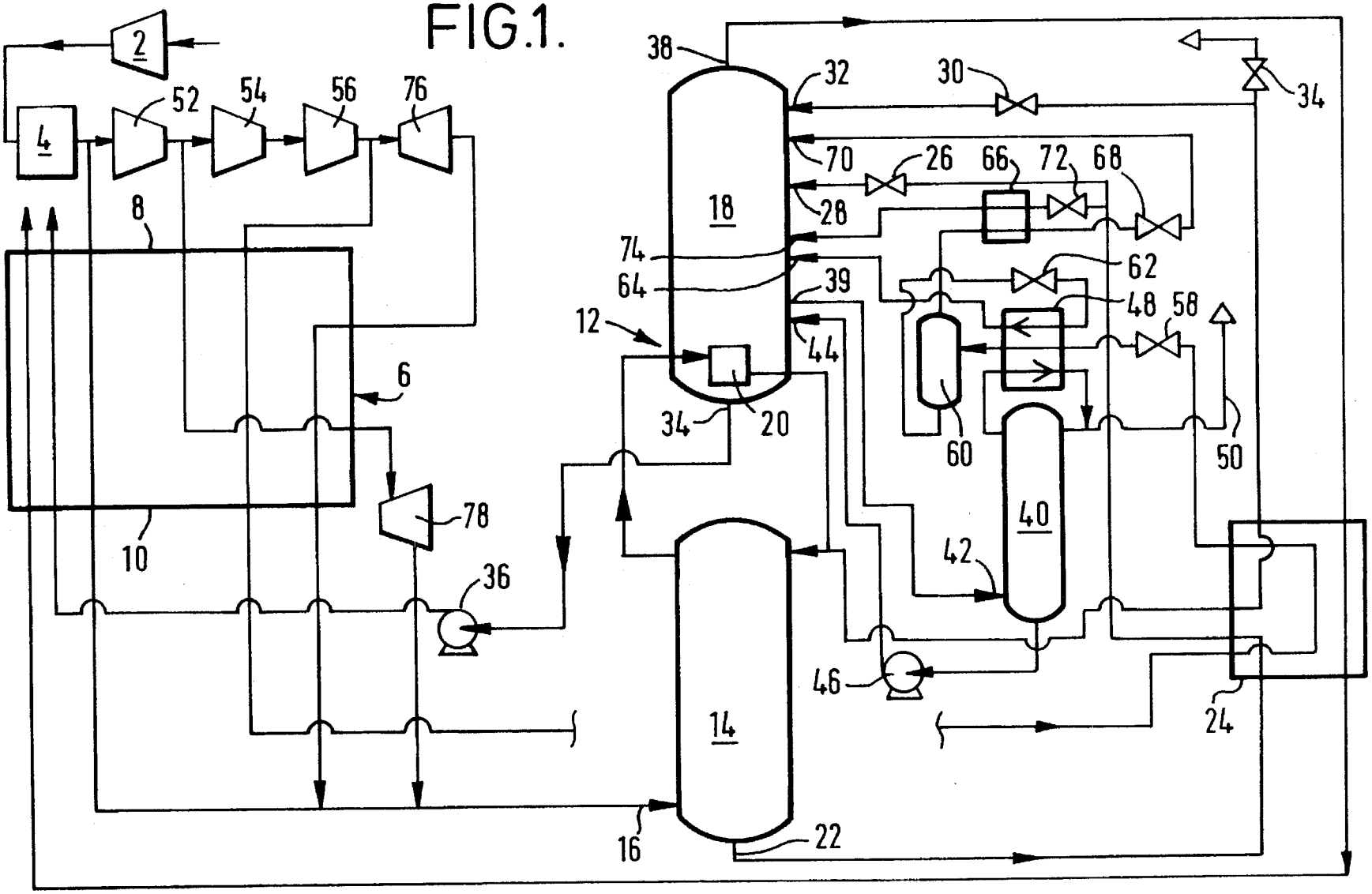
FIG. 1 is a schematic flow diagram of a first air separation plant according to the invention.

Referring to FIG. 1 of the accompanying drawings, a feed air stream is compressed in a compressor 2 and the resulting compressed feed air stream is passed through a purification unit 4 effective to remove water vapour and carbon dioxide therefrom. Unit 4 employs beds (not shown) of adsorbent to effect this removal of water vapour and carbon dioxide. The beds are operated out of sequence with one another such that while one or more beds are purifying the feed air stream, the remainder are being regenerated, for example, by being purged with a stream of hot nitrogen. Such purification units and their operation are well known in the art and need not be described further.

A first air stream is taken from the purified air and is passed through a main heat exchanger 6 from its warm end 8 to its cold end 10. The first air stream is thus reduced in temperature from about ambient temperature to a temperature suitable for its separation by rectification (e.g. its dew point temperature). The cooled first air stream is introduced into a higher pressure column 14 through an inlet 16 located below all liquid-vapour mass exchange devices (not shown) located therein. The higher pressure column 14 forms part of a double rectification column 12 which additionally includes a lower pressure rectification column 18. In the higher pressure rectification column 14 ascending vapour comes into intimate contact with descending liquid and mass exchange takes place on the liquid-vapour mass exchange devices which may take the form of packing or trays. The descending liquid is created by withdrawing nitrogen vapour from the top of the higher pressure rectification column 14, condensing the vapour in the condensing passages of a condenser-reboiler 20 and returning a part of the resulting condensate to the top of the column 14 so that it can flow downwardly therethrough as reflux. The vapour becomes progressively enriched in nitrogen as it ascends the higher pressure column 14.

Liquid approximately in equilibrium with the air that enters the higher pressure column 14 through the inlet 16, and hence somewhat enriched in oxygen, collects at the bottom of the higher pressure rectification column 14. A stream of this oxygen-enriched liquid air is withdrawn from the higher pressure rectification column 14 through an outlet 22 and is sub-cooled by passage through a heat exchanger 24. The sub-cooled oxygen-enriched liquid air stream is divided into two subsidiary streams. One subsidiary stream is passed through a throttling valve 26 and is introduced into the lower pressure rectification column 18 through an inlet 28. The flow of the second subsidiary stream of sub-cooled oxygen-enriched liquid air will be described below.

The oxygen-enriched liquid air introduced into the lower pressure rectification column 18 through the inlet 28 is separated therein into oxygen and nitrogen. Liquid-vapour contact devices (not shown) are employed in the lower pressure rectification column 18 in order to effect mass exchange between descending liquid and ascending vapour. As a result of this mass exchange the ascending vapour becomes progressively richer in nitrogen and the descending liquid progressively richer in oxygen. The liquid-vapour contact devices (not shown) may take the form of distillation trays or of packing. In order to provide liquid nitrogen reflux for the lower pressure rectification column 18, a stream of liquid nitrogen condensate is taken from the condenser-reboiler 20 and rather than being returned to the higher pressure rectification column 14 with the rest of the condensate is sub-cooled by passage through the heat exchanger 24. The sub-cooled liquid nitrogen stream is divided into two subsidiary streams. One of these subsidiary streams is passed through a throttling valve 30 and is introduced into the top of the lower pressure rectification column 18 through an inlet 32. The other subsidiary stream of liquid nitrogen is passed through a throttling valve 34 and is collected as product in a thermally-insulated storage tank (not shown).

The condenser-reboiler 20 reboils liquid oxygen at the bottom of the lower pressure rectification column 18 and thus provides the upward flow of vapour through the column 18. A stream of liquid oxygen is withdrawn from the bottom of the lower pressure rectification column 18 through an outlet 34 by operation of a pump 36 which raises the pressure of the liquid oxygen to a chosen elevated pressure typically above that at the top of the higher pressure rectification column 14. If desired, the pump 36 may raise the oxygen to a supercritical pressure. The resulting pressurised oxygen stream flows through the heat exchanger 6 from its cold end 10 to its warm end 8 and is thus warmed to approximately ambient temperature. If desired, a second stream of liquid oxygen product may be taken and collected as liquid product.

A gaseous nitrogen product is withdrawn from the top of the lower pressure rectification column 18 through an outlet 38, is warmed in the heat exchanger 24 by countercurrent heat exchange with the streams being sub-cooled and is further warmed to approximately ambient temperature by passage through the main heat exchanger 6 from its cold end 10 to its warm end 8. If there is no use for this nitrogen product, it may be vented back to the atmosphere.

In order to produce an argon product, a stream of argon-enriched oxygen vapour is withdrawn from the lower pressure rectification column 18 through an outlet 39 situated below the level of the inlet 28 and below the mass exchange level of the column where the argon concentration is a maximum. The argonen-riched oxygen vapour stream, typically containing from 5 to 15% by volume of argon, is introduced into the bottom of an argon rectification column 40 through an inlet 42. Liquid-vapour contact devices (not shown) are located in the argon rectification column 40 and enable mass transfer to take place therein between an ascending vapour phase and a descending liquid phase. The liquid-vapour contact devices typically take the form of a low pressure drop packing such as the structured packing sold by Sulzer Brothers under the trademark MELLAPAK. Depending on the height of packing within the column 40, an argon product typically containing up to, say, 2% of oxygen impurity may be produced. If sufficient height of packing is employed, the oxygen impurity level in the argon may be reduced to less than 10 volumes per million. An oxygen stream depleted in argon is withdrawn from the bottom of the argon rectification column 40 and is returned through an inlet 44 to the lower pressure rectification column 18. Depending on the height of the bottom of the argon rectification column 40 relative to the height of the inlet 44, a pump 46 may be employed to transfer the argon-depleted liquid oxygen from the bottom of the argon rectification column 40 to the lower pressure rectification column 18.

Reflux for the argon rectification column 40 is provided by condensing argon-rich vapour taken from the top thereof in the condensing passages of a first condenser 48. A part of the resulting condensate is returned to the top of the column 40 as reflux while the remainder is taken through a conduit 50 as product liquid argon. If desired, in an alternative process, a part of the argon-rich vapour may be taken as argon product and all the condensate from the first condenser 48 returned to the top of the argon column 40 as reflux. Another alternative is to take the argon product at a mass exchange level several theoretical plates below the top of the argon column so as to minimise the nitrogen content of the argon product. Alternatively, if desired, a separate fractionation column may be used to separate nitrogen impurity from the argon.

In order to provide cooling for the condenser 48, that part of the purified air from the unit 4 which is not taken as the first air stream is further compressed in a sequence of three compressors 52, 54 and 56. A part of the compressed air exiting the compressor 56 is taken as a second air stream and is cooled in the main heat exchanger by passage from its warm end 8 to its cold end 10. The thus cooled second air stream is further cooled by passage through the heat exchanger 24. From the heat exchanger 24 the second air stream flows through a throttling valve 58 which reduces its pressure to a value of approximately 2.3 bar. If the second air stream is not in liquid state at the inlet to the throttling valve 58 (because it is at a supercritical pressure) its passage through the throttling valve 58 will convert it to essentially liquid although some flash gas may also be formed. The liquid second air stream leaves the throttling valve 58, flows through the first condenser 48 and provides part of the cooling necessary for the condensation of argon-rich vapour therein. The second air stream is partly reboiled by indirect heat exchange with the condensing argon-rich vapour. Typically, from 40 to 60% by volume of the liquid air in the second air stream at the inlet to its heat exchange passages of the first condenser 48 is vaporised during its passage through these heat exchange passages. Because oxygen is less volatile than nitrogen the partial reboiling in the condenser 48 has the effect of enriching the liquid phase in oxygen and depleting the vapour phase of oxygen. The partly reboiled second air stream on exiting the first condenser 48 has its liquid and vapour phases disengaged from one another in a phase separator 60. A stream of the resulting oxygen-enriched liquid, for example containing about 32% by volume of oxygen, is withdrawn from the bottom of the phase separator 60, is reduced in pressure by passage through a throttling valve 62 and flows through another set of heat exchange passages in the first condenser 48 so as to provide the rest of the cooling necessary for the condensation of the argon vapour therein. The oxygen-enriched liquid stream is reboiled during its passage through the first condenser 48 and the resulting vapour is introduced into the lower pressure rectification column 18 for separation therein through an inlet 64 at a mass exchange level thereof above that of the inlet 44 but below that of the inlet 28. Typically, the throttling valve 62 reduces the pressure of the oxygen-enriched liquid taken from the phase separator 60 to approximately the operating pressure of the lower pressure rectification column 18 at the level of the inlet 64.

A stream of oxygen-depleted vapour, for example containing about 13% by volume of oxygen, is withdrawn from the top of the phase separator 60 and is condensed by flow through the condensing heat exchange passages of a second condenser 66. The resulting oxygen-depleted condensate flows through a throttling valve 68 and is introduced into the lower pressure rectification column 18 through an inlet 70 at a mass-exchange level thereof below that of the inlet 32 but above that of the inlet 28. Cooling for the second condenser 66 is provided by taking the second subsidiary stream of the sub-cooled oxygen-enriched liquid air that is withdrawn from the higher pressure column 14 through the outlet 22 (i.e. The part of the sub-cooled oxygen-enriched liquid air which is not introduced into the lower pressure rectification column 18 through the inlet 28), and passing it through a further throttling valve 72. The resulting pressure-reduced, oxygen-enriched, liquid air flows through the reboiling passages of the second condenser 66 and is thus reboiled in the condenser 66 by indirect heat exchange with the oxygen-depleted vapour. The reboiled stream from the second condenser 66 is introduced into the lower pressure rectification column 18 through an inlet 74 which is typically at approximately the same mass exchange level as the inlet 64.

The various streams introduced into the lower pressure rectification column 18 through the inlets 44, 64, 70 and 74 are separated therein with the oxygen-enriched liquid air stream introduced through the inlet 28. Typically, oxygen and nitrogen products each containing substantially less than 1% by volume of impurities are produced in the column 18.

As is well known in the art, refrigeration is created for the plant shown in FIG. 1 of the drawings at a rate dependent upon the rate of production of liquid products. The plant shown in FIG. 1 is intended to produce liquid products at a rate of greater than 15% of the total production of oxygen. Accordingly, a considerable amount of refrigeration is required and therefore two expansion turbines are employed to generate the necessary refrigeration. A "warm" turbine 76 takes air at approximately ambient temperature from the outlet of the compressor 56 and expands it to a pressure a little above that at the bottom of the higher pressure column 14 with the performance of external work. The resulting expanded air stream leaves the turbine 76 at a temperature of about 160K and is introduced into the main heat exchanger 6 at an intermediate region thereof. The expanded air stream flows from this intermediate region to the cold end 10 of the heat exchanger 6 and is mixed with the first air stream at a region of the first air stream downstream of the cold end 10 of the main heat exchanger 6. Further refrigeration is provided by taking a part of the compressed air stream from the outlet of the compressor 52, passing it through the main heat exchanger 6 from its warm end 8 to an intermediate region thereof, withdrawing it typically at a temperature of about 160K from the intermediate region, and expanding it in a second expansion turbine 78 with the performance of external work. The resulting expanded air leaves the turbine 78 at a temperature suitable for its rectification and at a pressure of approximately that at the bottom of the higher pressure column 14. The expanded air from the expansion turbine 78 is mixed with the first air stream at a region thereof downstream of the cold end 10 of the main heat exchanger 6.

Figure 2:
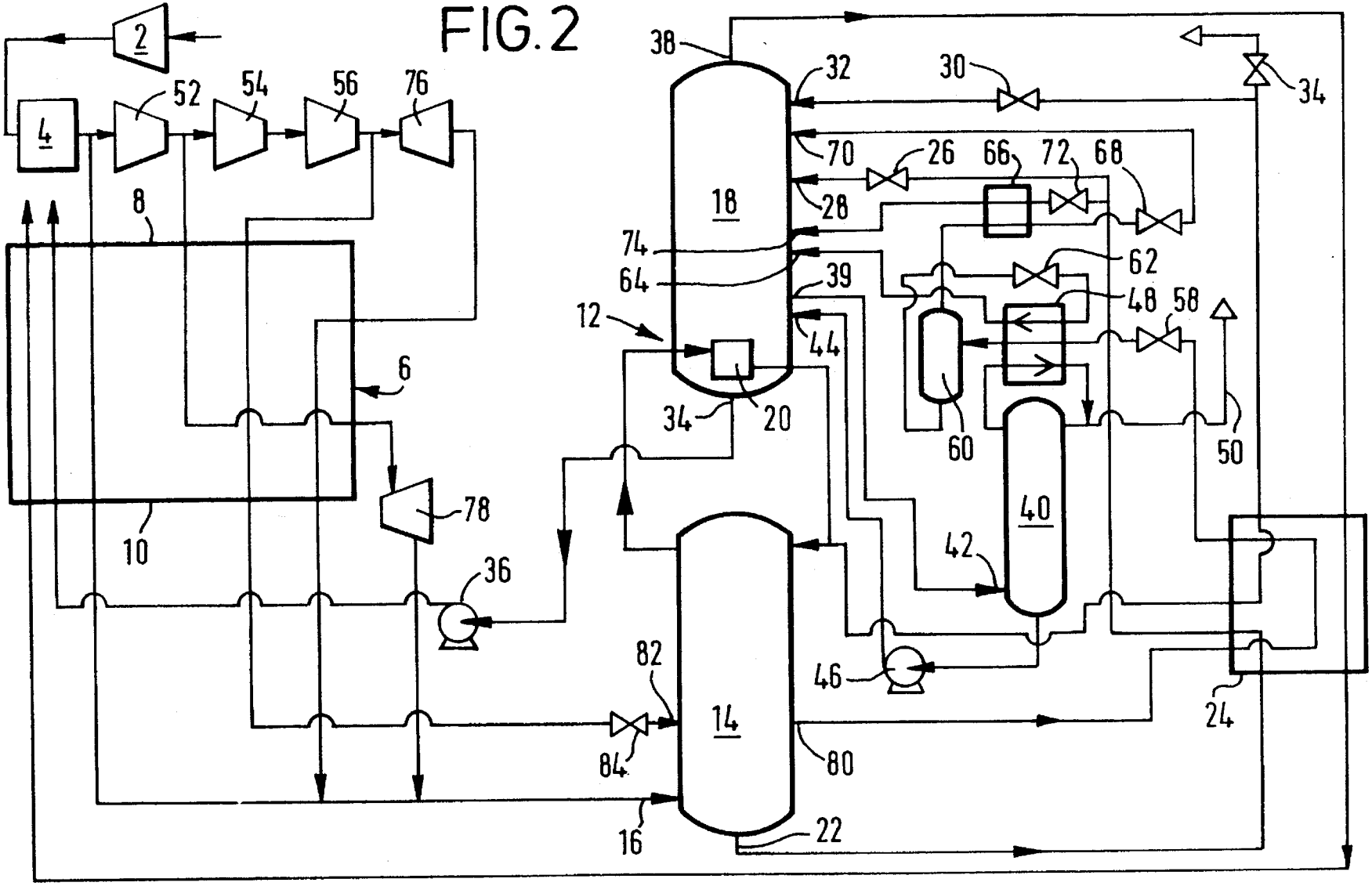
FIG. 2 is a schematic flow diagram of a second air separation plant according to the invention.

Referring now to FIG. 2 of the accompanying drawings, the plant shown therein is analogous in all respects save one to that shown in FIG. 1. Accordingly, like parts in the two figures are identified by the same reference numerals. Moreover, only in the respect that it differs from that shown in FIG. 1 will the plant shown in FIG. 2 and its operation be described therein. This difference concerns the formation of the second air stream. In the plant shown in FIG. 1 the second air stream is taken from the compressor 56. In the plant shown in FIG. 2 the second air stream is taken from an outlet 80 at intermediate mass exchange level of the higher pressure column 14. In order to permit the second air stream to be so taken from the higher pressure column 14 in liquid state without adversely affecting the operating efficiency of that column a precursor stream is introduced into the higher pressure rectification column 14 through an inlet 82 the same mass exchange level as the outlet 80. The precursor stream is formed from part of the air that leaves the outlet of the compressor 56. The precursor stream is cooled to a temperature suitable for its rectification by passage through the main heat exchanger 6 from its warm end 8 to its cold end 10. The thus-cooled precursor stream is passed through a throttling valve 84 to the inlet 82.

In the plants shown in FIGS. 1 and 2 there are a number of factors which tend to reduce the liquid/vapour (L/V) ratio in the upper regions of the lower pressure rectification column 18. These include the introduction of liquid air into the lower pressure rectification column 18 (the liquid air being formed as a result of a need to vaporise pressurised liquid oxygen to form a gaseous oxygen product) and the use of part of the nitrogen separated in the higher pressure column 14 to form nitrogen product rather than liquid nitrogen reflux for the double rectification column 12. The effect of such a reduced L/V ratio would be to reduce the yield of the argon product. In comparison with a conventional process in which the argon column condenser is cooled solely by a part of the oxygen-enriched liquid withdrawn from the bottom of the higher pressure rectification column, the method according to the invention is able to provide an increased L/V ratio, making it possible to maintain a high argon yield when the conventional product would not be able to achieve such a result. Accordingly, in comparison, the method according to the invention makes possible an increased rate of argon production for a given power consumption.

Analogously, in alternative examples of the method according to the invention, not illustrated in the accompanying drawings, by employing a refrigeration system that utilises an expansion turbine whose outlet communicates directly with an intermediate masse exchange region of the lower pressure rectification column, it is possible to pass a relatively greater proportion of the total air feed through that turbine thereby reducing the overall power consumption without reducing the argon yield (in comparison with the conventional process) or, for example, to derive nitrogen product at a greater rate from that separated in the higher pressure rectification column.

Another way of deriving a tangible economic advantage from the invention is to employ a lower pressure rectification column employing a lower number of "theoretical plates" than in the conventional process without loss of argon yield. Accordingly, the capital cost of the lower pressure rectification column may be reduced.

The above-described advantages are achieved by virtue of a relatively high temperature difference between the vaporising and condensing fluids in the condenser at the head of the argon column, which temperature difference arises as a result of the choice of fluid to provide cooling for the argon condenser.

In a typical example of the operation of the plant shown in FIG. 2 of the accompanying drawings, the compressor 2 has an outlet pressure of approximately 6 bar; the compressor 52 an outlet pressure of approximately 23 bar; the compressor 56 an outlet pressure of approximately 65 bar; the expansion turbine 76 an outlet pressure of approximately 6 bar; the expansion turbine 78 an outlet pressure of approximately 6 bar, and the liquid oxygen pump 36 an outlet pressure of 30 bar. In addition, although not shown in FIG. 2, a medium pressure gaseous nitrogen product at a pressure of about 5.6 bar is taken directly from the top of the higher pressure rectification column 14. The lower pressure rectification column 18 operates with a pressure of about 1.4 bar at its top and the argon rectification column 40 with a pressure of about 1.3 bar at its top. In this example, liquid nitrogen product is produced at a rate of about 17.5% that at which oxygen products (both gaseous and liquid) are produced. A liquid oxygen product is produced at the same rate as the liquid nitrogen product. In addition, a medium pressure gaseous nitrogen product is taken directly from the higher pressure column 14 at about the same rate as that at which the liquid nitrogen product is produced. The argon yield or recovery is 90% (based on the argon content of the feed air).

I claim:

1. A method of separating air comprising:

compressing and purifying the air;

rectifying a first stream of compressed purified air in a double rectification column comprising a higher pressure column and a lower pressure column;

withdrawing oxygen-rich and nitrogen-rich product streams from the double rectification column;

rectifying in an argon rectification column a stream of argon-enriched fluid withdrawn from the lower pressure column so as to obtain argon-rich vapour at the head of the argon rectification column;

condensing at least some of the said argon-rich vapour and employing at least some of the resulting condensate in the argon rectification column as reflux;

withdrawing an argon-rich product stream from the argon rectification column;

partially reboiling a second stream of compressed, purified air in a liquid state at a pressure greater than that at the top of the lower pressure column but less than that at the top of the higher pressure column so as to form an oxygen-enriched liquid and an oxygen-depleted vapour;

disengaging the oxygen-enriched liquid from the oxygen-depleted vapour;

condensing a stream of the oxygen-depleted vapour; and introducing the condensed oxygen-depleted vapour stream into the lower pressure rectification column;

the partial reboiling of the second stream of air being performed by indirect heat exchange thereof with said condensing argon-rich vapour.

2. The method as claimed in claim 1, in which the said disengaged oxygen-enriched liquid is used to perform a condensing duty.

3. The method as claimed in claim 2, in which a stream of the disengaged oxygen-enriched liquid is reduced in pressure and the resulting pressure-reduced stream of oxygen-enriched liquid supplements the second stream of air in condensing said argon-rich vapour.

4. The method as claimed in claim 3, in which the pressure-reduced stream of oxygen-enriched liquid is itself reboiled by indirect heat exchange with the condensing argon-rich vapour and the resulting reboiled stream is introduced into the lower pressure rectification column.

5. The method as claimed in claim 2, in which the said disengaged oxygen-enriched liquid is used to perform a condensing duty in a condenser located intermediate two intermediate mass exchange levels of the argon column.

6. The method as claimed in claim 5, in which a stream of the said disengaged oxygen-enriched liquid enters the intermediate condenser at the same pressure as that at which it is formed.

7. The method as claimed in claim 5 or claim 6, in which resulting reboiled oxygen-enriched liquid is returned to the lower pressure rectification column.

8. The method as claimed in claim 1, in which the stream of oxygen-depleted vapour is condensed by indirect heat exchange with a stream of oxygen-enriched liquid withdrawn form the higher pressure column.

9. The method as claimed in claim 8, in which the said stream of oxygen-enriched liquid withdrawn form the higher pressure column is reboiled by its heat exchange with the oxygen-depleted vapour, and the resulting reboiled stream of oxygen-enriched liquid is introduced into the lower pressure rectification column.

10. The method as claimed in claim 1, in which the second compressed, purified air stream is formed in liquid state by heat exchanging a stream of compressed, purified, gaseous air with a stream of oxygen-rich product in liquid state and passing the heat exchanged stream of compressed, purified air through a throttling valve.

11. The method as claimed in claim 1, in which the second compressed, purified air stream is taken in liquid state from the same intermediate mass exchange level of the higher pressure column as that to which a precursor compressed, purified air stream is fed in liquid state.

12. The method as claimed in claim 1, wherein from about 40 to about 60% by volume of the liquid air in the second compressed, purified air stream is vaporised by its heat exchange with the condensing argon vapour.

13. An air separation plant comprising:

a double rectification column comprising a higher pressure column and a lower pressure column for rectifying a first stream of compressed, purified air;

said double rectification column having an oxygen outlet for an oxygen-rich product stream and a nitrogen outlet for a nitrogen rich product stream;

an argon product rectification column having an inlet for a stream of argon-enriched fluid communicating with an argon outlet from the lower pressure column for said stream of argon-enriched fluid;

an argon product outlet from the argon rectification column for an argon-rich product;

a first condenser for condensing argon-rich vapour separated in the argon rectification column and for sending at least some of the condensate to the argon rectification column as reflux, the first condenser including one set of heat exchange passages for partially reboiling a second stream of compressed, purified air in liquid state at a pressure greater than that at the top of the lower pressure column but less than that at the top of the higher pressure column so as to form in use an oxygen-enriched liquid and an oxygen-depleted vapour;

a phase separator for disengaging the oxygen-enriched liquid from the oxygen-depleted vapour; and a second condenser having heat exchange passages for condensing a stream of the oxygen-depleted vapour;

said reboiling passages of the first condenser communicating with the lower pressure column.

14. The separation plant as claimed in claim 13, additionally including pressure-reducing means for reducing the pressure of a stream of the disengaged oxygen-enriched liquid.

15. The air separation plant as claimed in claim 13, wherein the first pressure-reduced oxygen-enriched liquid stream, said reboiling passages of the first condenser communicating with the lower pressure column.

16. The air separation plant as claimed in claim 13, in which the second condenser has reboiling passages communicating at their inlets with an outlet for oxygen-enriched liquid from the higher pressure column.

17. The air separation plant as claimed in claim 16, in which the reboiling passages of the second condenser communicate at their outlets with an inlet for reboiled oxygen-enriched liquid to the higher pressure column.

18. The air separation plant as claimed in claim 13, additionally including means for forming the second compressed, purified air stream in liquid state comprising a heat exchanger for heat exchanging a gaseous compressed, purified air stream with product oxygen-rich liquid, and a throttling valve for reducing the pressure of the compressed, purified air stream downstream of the heat exchanger.

19. The air separation plant as claimed in claim 13, additionally including an outlet from an intermediate mass exchange level of the higher pressure column for the second compressed, purified air stream in liquid state and an inlet to the higher pressure column at the same intermediate mass exchange level thereof for a precursor stream of compressed, purified air in liquid state.

* * * * *